United States Patent [19]

Horii et al.

[11] Patent Number: 4,506,638

[45] Date of Patent: Mar. 26, 1985

[54] METHOD AND APPARATUS FOR CONTROLLING FUEL CUT-OFF IN AN INTERNAL COMBUSTION ENGINE

[75] Inventors: Kingo Horii; Takatoshi Masui, both of Susono, Japan

[73] Assignee: Toyota Jidosha Kabushiki Kaisha, Toyota, Japan

[21] Appl. No.: 561,517

[22] Filed: Dec. 14, 1983

[30] Foreign Application Priority Data

Apr. 4, 1983 [JP] Japan ..... 58-57778

[51] Int. Cl.[3] ..... F02D 5/00

[52] U.S. Cl. ..... 123/325; 123/333

[58] Field of Search ..... 123/320, 325, 332, 333; 261/DIG. 19; 180/233, 284

[56] References Cited

U.S. PATENT DOCUMENTS 4,204,513 5/1980 Bilbrey et al. ..... 123/332
4,305,365 12/1981 Iizuka et al. ..... 123/325
4,391,243 7/1983 Bessho ..... 123/325
4,392,467 7/1983 Miyagi et al. ..... 123/325
4,421,082 12/1983 Katayose et al. ..... 123/179 G
4,434,759 3/1984 Iezuka et al. ..... 123/333

*Primary Examiner*—William A. Cuchlinski, Jr.
*Attorney, Agent, or Firm*—Cushman, Darby & Cushman

[57] ABSTRACT

In an internal combustion engine mounted on a four wheel drive (4WD) vehicle, the fuel cut-off engine speed ($N_c$) and the fuel cut-off recovery engine speed ($N_R$) are calculated in accordance with the coolant temperature of the engine. When the vehicle is in a 4WD mode, predetermined minimum values are set in the calculated fuel cut-off engine speed and the calculated fuel cut-off engine speed. When the throttle valve is completely closed and it is determined that the current engine speed is higher than the calculated fuel cut-off engine speed ($N_c$) or the calculated fuel cut-off recovery engine speed ($N_R$), which is selected in accordance with whether or not the fuel cut-off operation was being carried out, the fuel cut-off operation is carried out.

4 Claims, 10 Drawing Figures

INT
701
LL = "1" ?
702
NO
YES
IS 4WD POSITION ?
703
NO
YES
IS BRAKE SWITCH OFF ?
704
NO
YES
NR < 1800 ?
705
NO
YES

METHOD AND APPARATUS FOR CONTROLLING FUEL CUT-OFF IN AN INTERNAL COMBUSTION ENGINE

BACKGROUND OF THE INVENTION

1. Field of the Invention

The present invention relates to a method and apparatus for controlling the fuel cut-off in an internal combustion engine mounted on a four-wheel drive (4WD) vehicle.

2. Description of the Prior Art

In general, the fuel cut-off is activated to stop the injection of fuel during deceleration, thereby improving fuel consumption. The control of the fuel cut-off depends upon the opening of a throttle valve, the engine speed, and the like. For example, when the throttle valve is completely closed and the engine speed is higher than the required fuel cut-off engine speed, the fuel cut-off is activated. Contrary to this, when the throttle valve is not completely closed, or when the engine speed is lower than the required fuel cut-off recovery engine speed, the fuel cut-off is released. In this case, the fuel cut-off engine speed is higher than the fuel cut-off recovery engine speed, thereby obtaining the hysteresis characteristics of the engine speed. In addition, both the fuel cut-off engine speed and the fuel cut-off recovery engine speed are dependent upon engine state parameters such as the coolant temperature of the engine.

In a 4WD vehicle, a higher driving power is generally required during the 4WD mode than during the 2WD mode, and accordingly, the transmission gear ratio is lower during the 4WD mode than during the 2WD mode. As a result, even at the same vehicle speed, the engine speed during the 4WD mode is higher than the engine speed during the 2WD mode.

In the prior art, the fuel cut-off is activated under the same conditions, regardless of whether or not the vehicle is in the 4WD mode or the 2WD mode. That is, the fuel cut-off engine speed during the 4WD mode is the same as the fuel cut-off engine speed during the 2WD mode, and the fuel cut-off recovery engine speed during the 4WD mode is the same as the fuel cut-off recovery engine speed during the 2WD mode.

In the above-mentioned prior art, however, since the transmission gear ratio is lower during the 4WD mode than during the 2WD mode, the fuel cut-off is activated more frequently during the 4WD mode than during the 2WD mode. That is, the fuel cut-off operation and the fuel cut-off recovery operation are repeated frequently during the 4WD mode.

It should be noted that the vehicle is generally driven in the 4WD mode on a snow-covered road, a sandy road, a mountain road, an uneven-surface road, or the like, in which conditions it is difficult to drive in the 2WD mode. Therefore, such frequent repetition of the fuel cut-off and fuel cut-off recovery operations lowers the driving performance during the 4WD mode, compared with that during the 2WD mode, since a minus torque caused by the fuel cut-off, a plus torque caused by the fuel cut-off recovery, and the torque changes due to the minus and plus torques are transmitted to all four wheels.

SUMMARY OF THE INVENTION

It is an object of the present invention to provide a method and apparatus for controlling the fuel cut-off in an internal combustion engine mounted on a 4WD vehicle, in which the fuel cut-off conditions are more severe during the 4WD mode than during the 2WD mode, so that the number of the fuel cut-off and fuel cut-off recovery operations to be carried out are reduced, thereby improving the driving performance during the 4WD mode.

According to the present invention, a means is provided for determining whether or not the throttle valve is completely closed. A means is provided for calculating a fuel cut-off engine speed $N_c$ in accordance with the coolant temperature THW of the engine. A means is provided for calculating a fuel cut-off recovery engine speed $N_R$ in accordance with the coolant temperature THW. A means is provided for determining whether or not the vehicle is in the 4WD mode or in the 2WD mode. In the 4WD mode, a lower limit such as 2100 rpm is applied to the fuel cut-off engine speed $N_c$, and in addition, a lower limit such as 1800 rpm is applied to the fuel cut-off recovery engine speed $N_R$. In addition, a means is provided for determining whether or not the fuel cut-off is activated. When the throttle valve is completely closed and the fuel cut-off is not activated, the current engine speed $N_e$ is compared with the fuel cut-off engine speed $N_c$. When the throttle valve is completely closed and the fuel cut-off is activated, the current engine speed $N_e$ is compared with the fuel cut-off recovery engine speed $N_R$. As a result, when $N_e \geqq N_c$ or $N_e \geqq N_R$, the fuel injection amount is made zero, carrying out the fuel cut-off operation. On the other hand, when the throttle valve is not completely closed, or when $N_e < N_c$ or $N_e < N_R$, the fuel injection amount is calculated in accordance with predetermined engine parameters.

According to another aspect of the present invention, there is added a means for determining whether or not the mechanical brakes are applied. When the mechanical brakes are applied, the above-mentioned lower limits are not applied to the fuel cut-off engine speed $N_c$ and the fuel cut-off recovery engine speed $N_R$.

Thus, according to the present invention, the number of fuel cut-off and fuel cut-off recovery operations during the 4WD mode can be reduced, thereby improving the driving performance during the 4WD mode.

BRIEF DESCRIPTION OF THE DRAWINGS

The present invention will be more clearly understood from the description as set forth below with reference to the attached drawings, wherein.

DESCRIPTION OF THE PREFERRED EMBODIMENT

Figure 1:
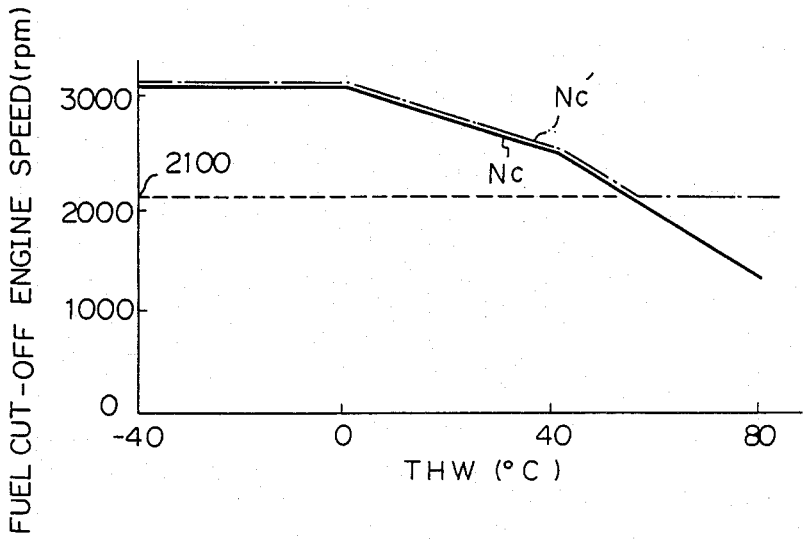
FIG. 1 is a graph of the characteristics of the fuel cut-off engine speed according to the present invention.
Figure 2:
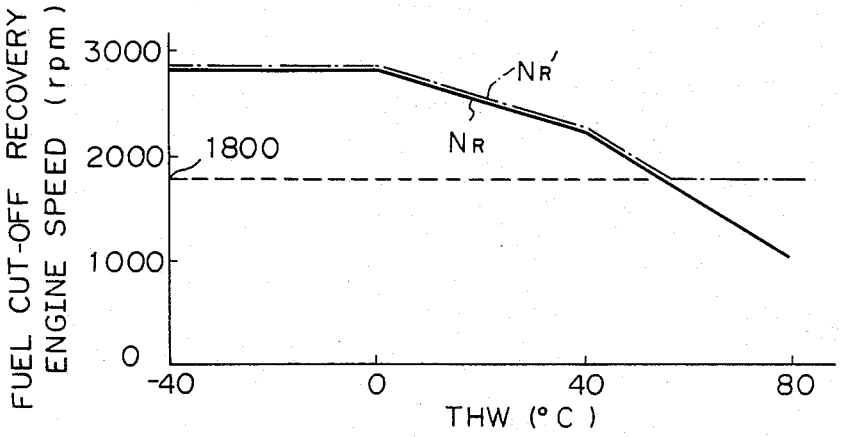
FIG. 2 is a graph of the characteristics of the fuel cut-off recovery engine speed according to the present invention.

In FIG. 1, which illustrates the characteristics of the fuel cut-off engine speed according to the present invention, reference $N_c$ designates the fuel cut-off engine speed during the 2WD mode, and $N_c'$ designates the fuel cut-off engine speed during the 4WD mode. In FIG. 2, which illustrates the characteristics of the fuel cut-off recovery engine speed according to the present invention, reference $N_R$ designates the fuel cut-off engine speed during the 2WD mode, and $N_R'$ designates the fuel cut-off recovery engine speed during the 4WD mode. The engine speeds $N_c$, $N_c'$, $N_R$, and $N_R'$ are calculated in accordance with the engine coolant temperature THW. However, a lower limit such as 2100 rpm is applied to the fuel cut-off engine speed $N_c'$ for the 4WD mode, and a lower limit such as 1800 rpm is applied to the fuel cut-off recovery engine speed $N_R'$. Thus, the number of fuel cut-off and fuel cut-off recovery operations during the 4WD mode can be reduced.

Note that the fuel cut-off engine speed $N_c$ (or $N_c'$) is higher than the fuel cut-off recovery engine speed $N_R$ (or $N_R'$), thereby obtaining the hysteresis characteristics of the engine speed. However, the difference between the fuel cut-off engine speed $N_c$ (or $N_c'$) and the fuel cut-off recovery engine speed $N_R$ (or $N_R'$) can be set at values other than the 300 rpm mentioned previously.

Figure 3:
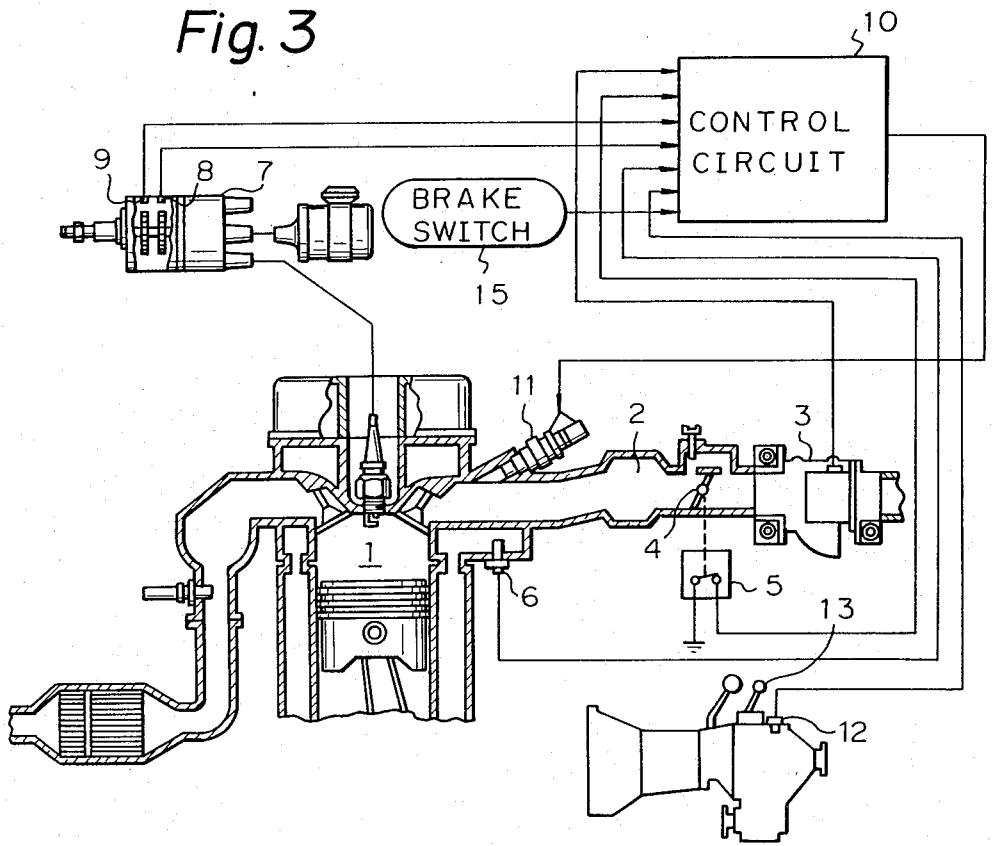
FIG. 3 is a schematic diagram of an internal combustion engine according to the present invention.

In FIG. 3, which illustrates an internal combustion engine according to the present invention, reference numeral 1 designates a four-cycle spark ignition engine disposed in an automotive vehicle. In an air-intake passage 2 of the engine 1, a potentiometer-type airflow meter 3 is provided for detecting the amount of air taken into the engine 1 to generate an analog voltage signal in proportion to the amount of air flowing therethrough. Also provided in the air-intake passage 2 is a throttle valve 4 which has a throttle sensor, i.e., an idle-position switch 5, at the shaft thereof. The idle-position switch 5 detects whether or not the throttle valve 4 is completely closed, i.e., in an idle position, to generate an idle signal "LL".

Disposed in a cylinder block of the engine 1 is a coolant temperature sensor 6 for detecting the temperature of the coolant. The coolant temperature sensor 6 generates an analog voltage signal in response to the temperature of the coolant.

Disposed in a distributor 7 are crank-angle sensors 8 and 9 for detecting the angle of the crankshaft (not shown) of the engine 1. In this case, the crank-angle sensor 8 generates a pulse signal at every 720° crank angle (CA) while the crank-angle sensor 9 generates a pulse signal at every 30° CA. The pulse signals of the crank-angle sensors 8 and 9 serve as interrupt-request signals for calculating the fuel-injection pulse duration, the ignition timing, and the like.

Additionally provided in the air-intake passage 2 are fuel injectors 11 for supplying pressurized fuel from the fuel system (not shown) to the corresponding air-intake ports of the respective cylinders of the engine 1.

Reference 12 designates a 4WD indicator switch which is explained in detail below with reference to FIG. 4. That is, when a 4WD gear shift lever 13 is moved to the right at the 4WD position, a slide shaft 14 coupled to the lever 13 is also moved to push up a T bar 12*a*. As a result, the electrical contacts 12*b* and 12*c* are closed, so that a 4WD indicator lamp (resistor) 15 is turned on. Therefore, the driver is informed that the vehicle is in the 4WD mode by the turned-on lamp 15. Simultaneously, the potential at the contact 12*c* is changed from high to low. Contrary to this, when the 4WD shift lever 13 is moved to the left to the 2WD position, the slide shaft 14 is also moved so that the T bar 12*a* is pushed down by a spring 12*d*. As a result, the electrical contacts 12*b* and 12*c* are opened, and accordingly, the potential at the contact 12*c* is changed from low to high. The potential at the contact 12*c* is transmitted as a digital signal to a control circuit 10 (see also FIG. 3).

Reference 16 designates a brake switch which is also explained in detail with reference to FIG. 4. When a mechanical brake pedal 17 is pushed down to press on a T bar 16*a*, the electrical contacts 16*b* and 16*c* are closed. As a result, a brake lamp (resistor) 18 is turned on, and the driver is informed that the mechanical brake is in operation by the lamp 18. Simultaneously, the potential at contact 16*c* is changed from high to low. Contrary to this, when the mechanical brake pedal 17 is released by the driver, the electrical contacts 16*b* and 16*c* are opened by a spring 16*d*. As a result, the lamp 18 is turned off and the potential at the contact 16*c* is changed from low to high. The potential at the contact 16*c* is transmitted as a digital signal to the control circuit 10.

Figure 4:
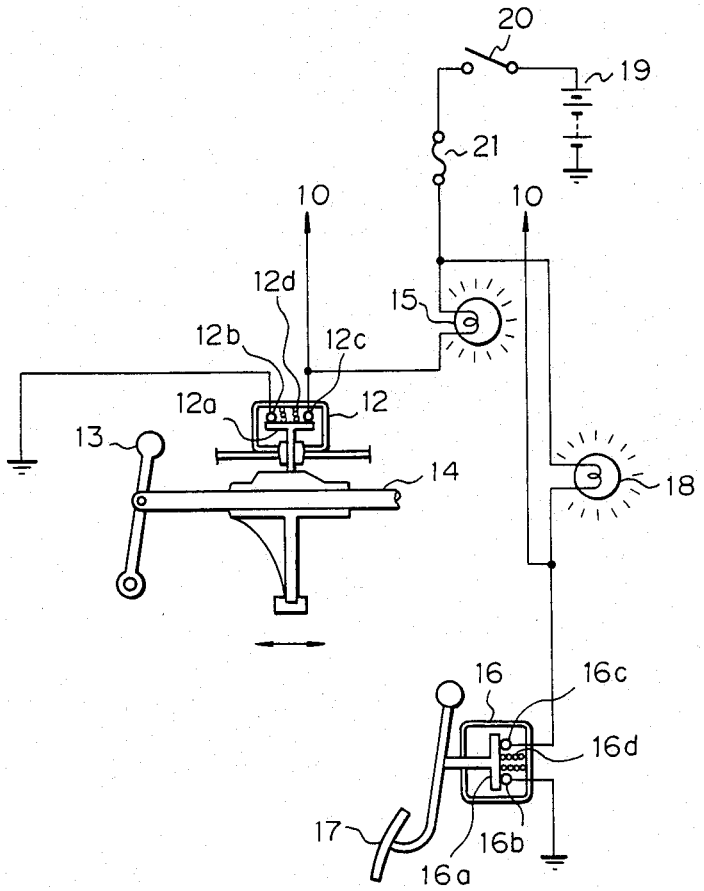
FIG. 4 is a schematic diagram of the 4WD indicator switch and the brake switch shown in FIG. 3.

In FIG. 4, reference 19 designates a battery, 20 an ignition switch, and 21 a fuse.

The control circuit 10 responds to the detection signals of the airflow meter 3, the coolant temperature sensor 6, the crank-angle sensors 8 and 9, the idle-position switch 5, the 4WD indicator switch 12, and the brake switch 16 to control the injectors 11. Note that such a control circuit 10 is comprised, for example, of a microcomputer.

Figure 5A:
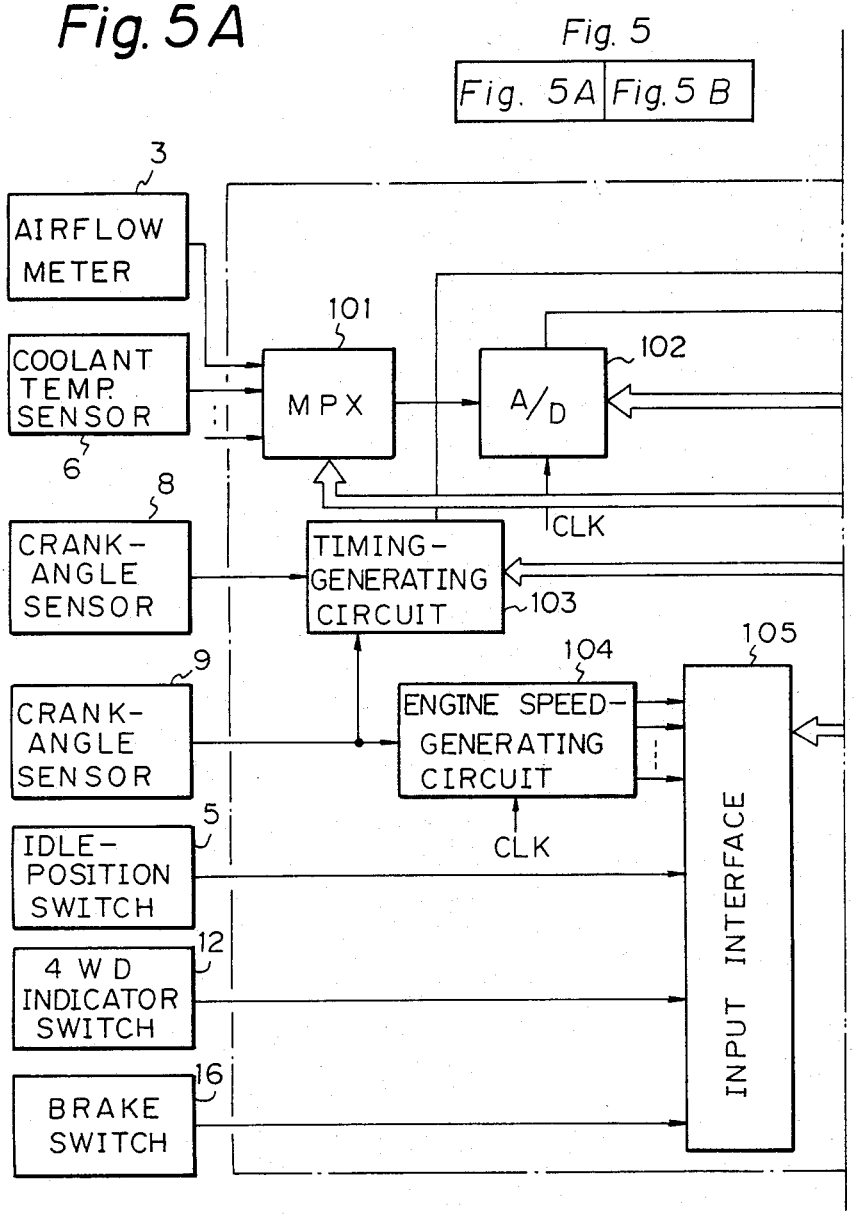
FIGS. 5A and 5B are a block diagram of the control circuit shown in FIG. 3.
Figure 5B:
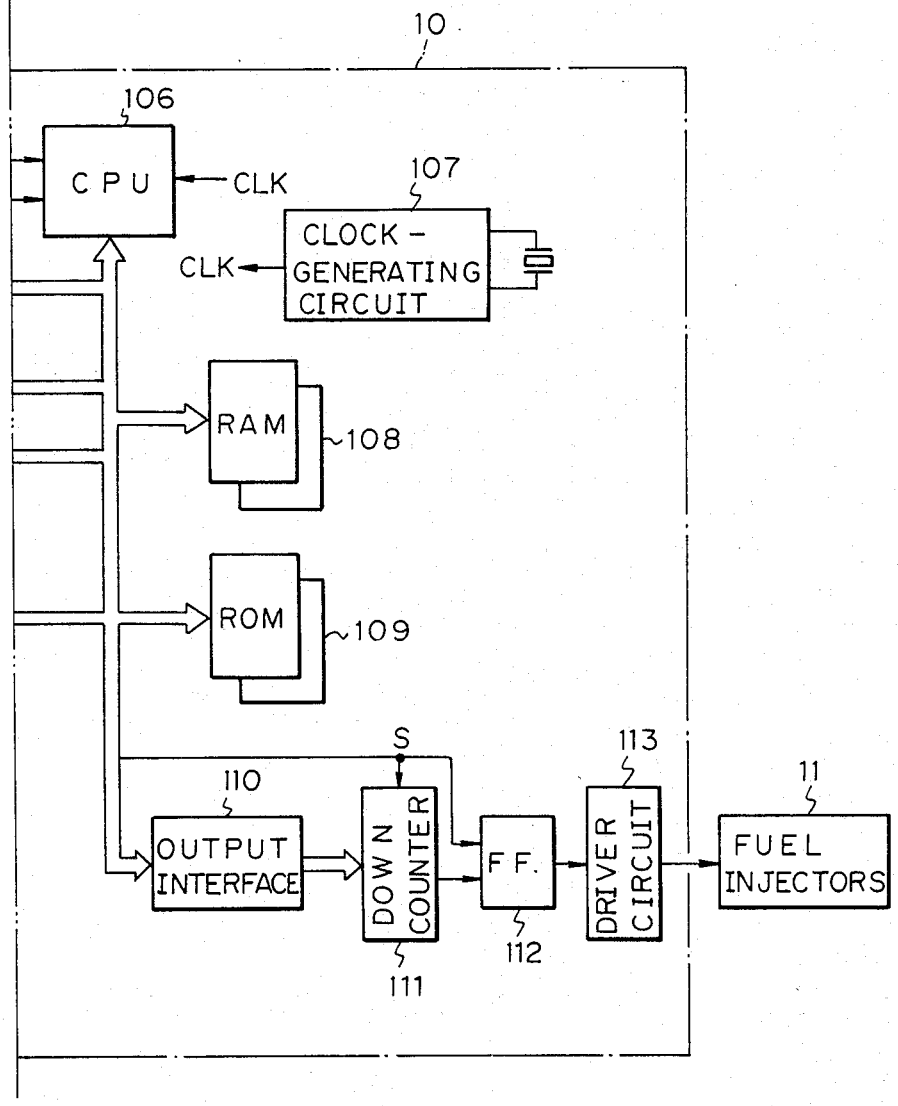

The control circuit 10 is explained in more detail with reference to FIG. 5. In FIG. 5, each analog signal from the airflow meter 3 and the coolant temperature sensor 6 is supplied via a multiplexer 101 to an analog/digital (A/D) converter 102. That is, the analog signal from the airflow meter 3 or the coolant temperature sensor 6 is selected by the multiplexer 101, which is controlled by a central processing unit (CPU) 106, and the selected signal is supplied to the A/D converter 102. The A/D converter 102 subjects each analog signal from the airflow meter 3 and the coolant temperature sensor 6 to A/D conversion by using a clock signal CLK from a clock-generating circuit 107. After each A/D conversion is completed, the A/D converter 102 transmits an interrupt-request signal to the CPU 106. As a result, in an interrupt routine, the CPU 106 successively stores each new piece of data from the airflow meter 3 or the coolant temperature sensor 6 in a predetermined area of a random-access memory (RAM) 108.

Each digital output signal from the crank-angle sensors 8 and 9 is supplied to a timing-generating circuit 103 for generating interrupt-request signals, reference-timing signals, and the like. The timing-generating circuit 103 comprises a timing counter which counts each pulse signal, generated at every 30° CA, of the crank-angle sensor 9 and is reset by each pulse signal, generated at every 720° CA, of the crank-angle sensor 8. Further, the digital output signal from the crank-angle sensor 9 is supplied via an engine speed-generating circuit 104 to predetermined positions of an input interface 105. The engine speed-generating circuit 104 comprises a gate, the on and off of which are controlled at every 30° CA, and a counter for counting the number of pulses of the clock signal CLK of the clock-generating circuit 107 when the gate is open. Thus, the engine speed-generating circuit 104 generates a binary-code signal which is inversely proportional to the rotational speed $N_e$ of the engine 1.

The digital output signals from the idle position switch 5, the 4WD indicator switch 12, and the brake switch 16 are supplied directly to predetermined positions of the input interface port 105.

A read-only memory (ROM) 109 stores programs such as the main routine, the fuel-injection-amount calculating routine, the ignition-timing calculating routine, and the like.

The CPU 106 reads the fuel-injection-amount data out of the RAM 108 and transmits it to a predetermined position of an output interface 110, and simultaneously, generates a strobe signal S. As a result, the fuel-injection-amount data is preset in a down counter 111 and a flip-flop 112 is set. Therefore, a driver circuit 113 initiates the activation of the fuel injectors 11. The down counter 111 counts the clock signal CLK from the clock-generating circuit 107, and finally, the down counter 111 generates a logic "1" signal from the carry-out terminal thereof. As a result, the flip-flop 112 is reset to stop the activation of the driver circuit 113. Thus, the amount of fuel corresponding to the above-mentioned fuel-injection-data is injected into the combustion chambers of the engine 1.

Figure 6:
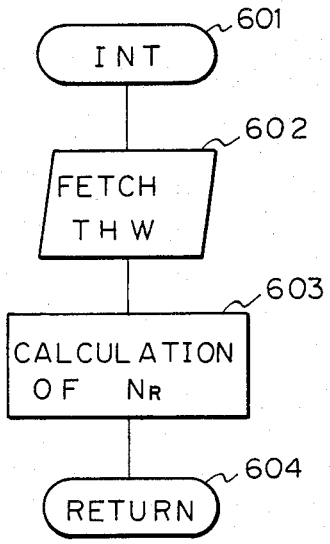
FIGS. 6, 7A, 7B and 8 are flow charts showing the operation of the control circuit shown in FIG. 3.
Figure 8:
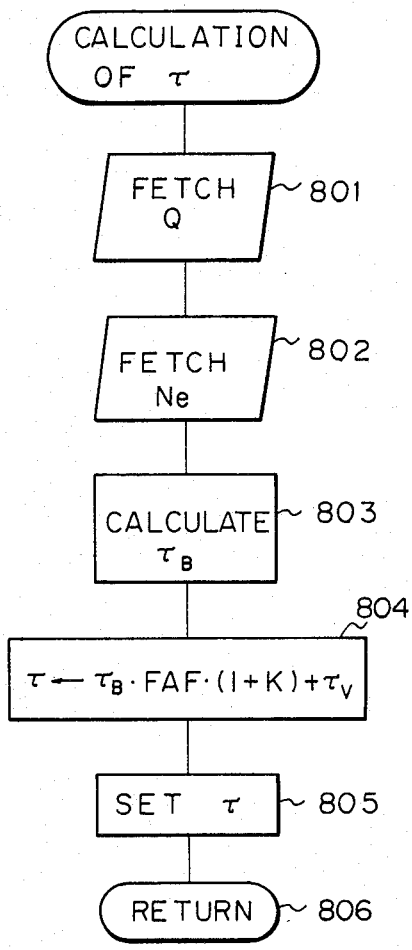
Figures 7, 7A, 7B:
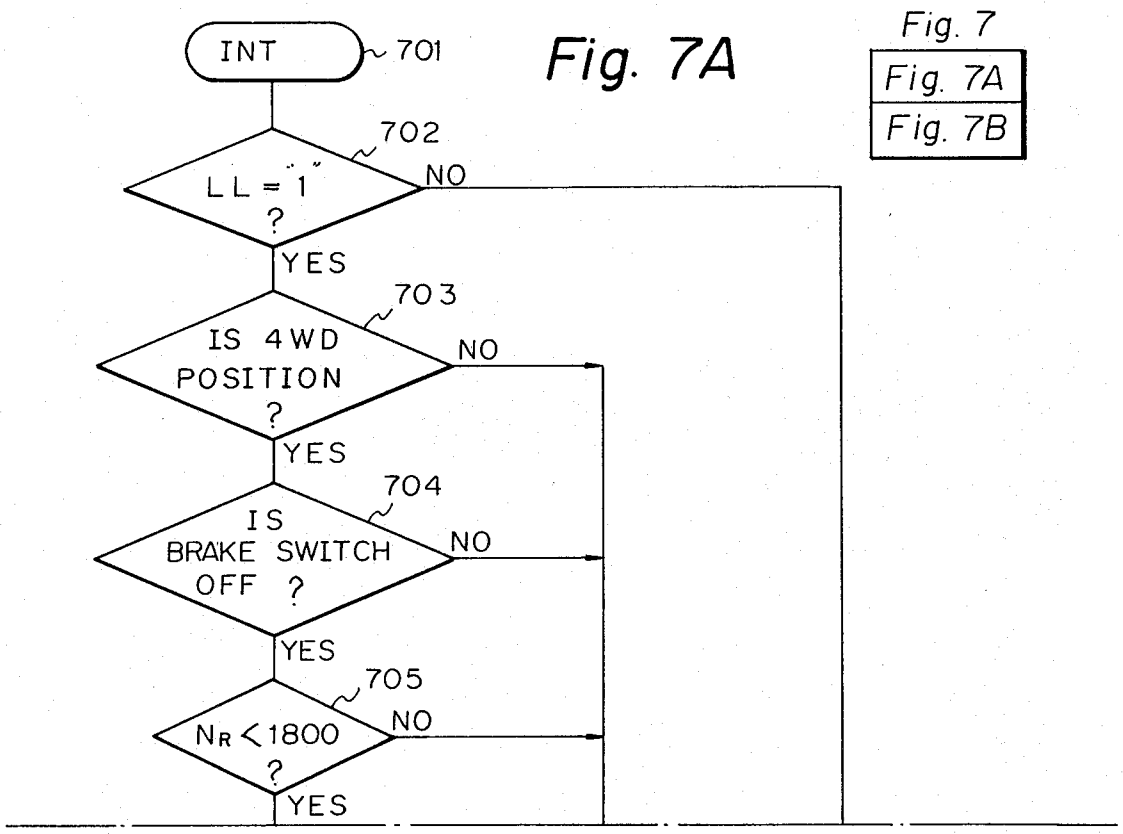
Figure 7B:
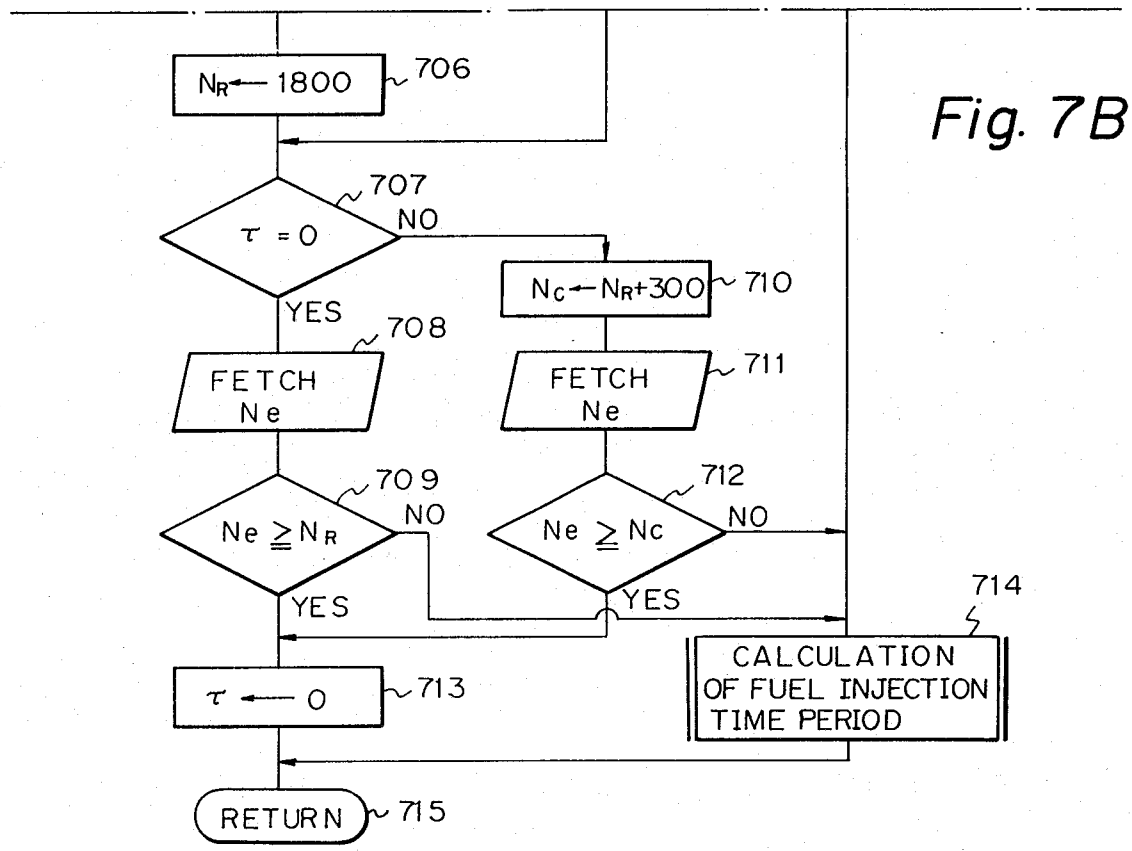

Operation of the control circuit shown in FIG. 3 is explained with reference to FIGS. 6, 7, and 8. FIG. 6 illustrates a flow chart of the calculation routine of the fuel cut-off recovery engine speed $N_R$, and FIG. 7 is a flow chart of the fuel cut-off operation routine. FIG. 8 is a detailed flow chart of step 714 shown in FIG. 7.

The routine shown in FIG. 6 is carried out at every predetermined time period, such as 20 ms. That is, every 20 ms, control enters into interrupt step 601, and then is transferred to step 602 in which the CPU 106 fetches the coolant temperature THW from the coolant temperature sensor 6. Next, at step 603, the CPU 106 calculates the fuel cut-off recovery engine speed $N_R$ based upon a one-dimensional map stored in the ROM 109 in accordance with the coolant temperature THW (See FIG. 2). Control is then transferred to step 604, thereby completing the routine shown in FIG. 6. As shown in FIGS. 1 and 2, there is a definite difference such as 300 rpm between the fuel cut-off engine speed $N_c$ and the fuel cut-off recovery engine speed $N_R$. Therefore, if only one of the values $N_c$ and $N_R$ is stored as a map into the ROM 109, the other can be easily obtained.

The routine shown in FIG. 7 is carried out at every predetermined CA, such as 360° CA. That is, every 360° CA, control enters into an interrupt-step 701 and is then transferred to step 702. At step 702, the CPU 106 determines whether or not the output LL of the idle-position switch 5 is "1", i.e., whether or not the throttle valve 4 is completely closed. Note the throttle valve 4 must be completely closed for the fuel cut-off operation to be carried out. Therefore, if the determination at step 702 is ΘNO", control is transferred to step 714, so that the fuel cut-off is not carried out. Contrary to this, if the determination at step 702 is "YES", control is transferred to step 703.

At steps 703 and 704, the CPU 106 determines whether or not to apply a lower limit to the fuel cut-off engine speed $N_c$ and the fuel cut-off recovery engine speed $N_R$. That is, at step 703, the CPU 106 determines whether or not the vehicle is driven in a 4WD mode by the output of the 4WD indicator switch 12. At step 704, the CPU 106 determines whether or not the mechanical brake is applied by the output of the brake switch 16. Only if both of the determinations at step 703 and 704 are "YES", is control transferred to step 705, in which the lower limit such as 1800 rpm is applied to the fuel cut-off recovery engine speed $N_R$.

In more detail, at step 705, the CPU 106 determines whether or not $N_R < 1800$ rpm. If $N_R < 1800$, control is transferred to step 706 in which the CPU 106 causes $N_R$ to be 1800 rpm. Control is then transferred to step 707. Contrary to this, if $N_R \geqq 1800$, control is transferred directly to step 707.

Thus, when the vehicle is driven in a b 4WD mode and the mechanical brake is not applied, the minimum value of the fuel cut-off recovery engine speed $N_R$ is 1800 rpm, and whether or not the value $N_R$ is higher than the minimum value is dependent upon the coolant temperature THW. That is, the fuel cut-off recovery engine speed is changed from $N_R$ to $N_R'$, shown in FIG. 2. The step 704 for the determination of the state of the mechanical brake will be helpful in improving the fuel consumption, however, this step can be omitted.

Next, at step 707, the CPU 106 reads the fuel-injection-data $\tau$ (time period) from the RAM 108 and determines whether or not the time period $\tau$ is zero, i.e., whether or not the fuel cut-off operation is being carried out. If the fuel cut operation is being carried out ($\tau=0$), control is transferred to step 709, in which the CPU 106 fetches the current engine speed $N_e$ from the engine speed-generating circuit 104. At step 709, the CPU 106 determines whether or not $N_e \geqq N_R$. As a result, if $N_e \geqq N_R$, control is transferred to step 713, in which the CPU 106 causes the fuel-injection time period $\tau$ to be zero, thereby continuing the fuel cut-off operation. If $N_e < N_R$, control is transferred to step 714, thereby ending the fuel cut-off operation.

At step 707, when it is determined that the fuel cut-off operation is not being carried out, control is transferred to step 710, in which the CPU 106 calculates the fuel cut-off engine speed $N_c$ by $N_c \leftarrow N_R + 300$. Control is then transferred to step 711 in which the CPU 106 fetches the current engine speed $N_e$ from the engine speed-generating circuit 104. Next, at step 712, the CPU 106 determines whether or not $N_e \geqq N_c$. If $N_e \geqq N_c$, control is transferred to step 713 in which the CPU 106 causes the fuel-injection time period $\tau$ to be zero, thereby starting the fuel cut-off operation. If $N_e < N_c$, control is transferred to step 714, so that the fuel cut-off operation is not carried out. The routine shown in FIG. 7 is ended by step 715.

The calculation step 714, fuel-injection time period $\tau$, is explained in detail with reference to FIG. 8. First, at step 801, the CPU 106 fetches the air-intake amount data Q via the multiplexer 101 and the A/D converter from the airflow meter 3, and at step 802, the CPU 106 fetches the current engine speed $N_e$. At step 803, the CPU 106 calculates a base fuel-injection time period $\tau_B$ based upon a two-dimensional map stored in the ROM 109, dependent upon the data Q and $N_e$. At step 804, the CPU 106 calculates the fuel-injection time period $\tau$ as follows:

$$\tau = \tau_B \cdot FAF \cdot (1+K) + \tau_v$$

where

FAF Is an air-fuel ratio correction factor;

K is a transient correction factor; and $\tau_v$ is an invalid time period.

At step 805, the CPU 106 sets the calculated fuel-injection time period $\tau$ via the output interface 110 in the down counter 111. Thus, the amount of fuel corresponding to the calculated time period $\tau$ is injected by the fuel injectors 11.

We claim:

1. A method for controlling the fuel cut-off in an internal combustion engine having a throttle valve therein mounted on a four wheel drive (4WD) vehicle, comprising the steps of:

determining whether or not said throttle valve is completely closed;

calculating the fuel cut-off engine speed in accordance with the coolant temperature of said engine;

calculating the fuel cut-off recovery speed in accordance with the coolant temperature of said engine;

determining whether said vehicle is in a 4WD mode or in a 2WD mode;

setting predetermined minimum values in said calculated fuel cut-off engine speed and said calculated fuel cut-off recovery engine speed when said vehicle is in the 4WD mode;

determining whether or not the fuelcut-off operation is performed upon said engine;

comparing the current engine speed with said calculated fuel cut-off engine speed, when said throttle valve is completely closed and the fuel cut-off operation is not performed;

comparing the current engine speed with said fuel cut-off recovery engine speed, when said throttle valve is completely closed and the fuel cut-off operation is performed;

causing the fuel-injection time period to be zero when said throttle valve is completely closed, and it is determined that the current engine speed is higher than said calculated fuel cut-off engine speed or said calculated fuel cut-off recovery engine speed; and calculating a fuel-injection time period based upon predetermined engine parameters, when said throttle valve is not completely closed, or when said throttle valve is completely closed and it is determined that the current engine speed is lower than said calculated fuel cut-off engine speed or said calculated fuel cut-off recovery engine speed.

2. A method as set forth in claim 1, further comprising the steps of:

determining whether or not the mechanical brakes are applied to said vehicle; and releasing the setting of said predetermined minimum values in said calculated fuel cut-off engine speed and fuel cut-off recovery engine speed, when said mechanical brakes are applied to said vehicle.

3. An apparatus for controlling the fuel cut-off in an internal combustion engine having a throttle valve therein mounted on a four wheel drive (4WD) vehicle, comprising:

means for determining whether or not said throttle valve is completely closed;

means for calculating the fuel cut-off engine speed in accordance with the coolant temperature of said engine;

means for calculating the fuel cut-off recovery speed in accordance with the coolant temperature of said engine;

means for determining whether said vehicle is in a 4WD mode or in a 2WD mode;

means for setting predetermined minimum values in said calculated fuel cut-off engine speed and said calculated fuel cut-off recovery engine speed when said vehicle is in the 4WD mode;

means for determining whether or not the fuel cut-off operation is performed upon said engine;

means for comparing the current engine speed with said calculated fuel cut-off engine speed, when said throttle valve is completely closed and the fuel cut-off operation is not performed;

means for comparing the current engine speed with said fuel cut-off recovery engine speed, when said throttle valve is completely closed and the fuel cut-off operation is performed;

means for causing the fuel-injection time period to be zero, when said throttle valve is completely closed and it is determined that the current engine speed is higher than said calculated fuel cut-off engine speed or said calculated fuel cut-off recovery engine speed; and means for calculating a fuel-injection time period based upon predetermined engine parameters, when said throttle valve is not completely closed, or when said throttle valve is completely closed and it is determined that the current engine speed is lower than said calculated fuel cut-off engine speed or said calculated fuel cut-off recovery engine speed.

4. An apparatus as set forth in claim 3, further comprising:

means for determining whether or not the mechanical brakes are applied to said vehicle; and means for releasing the setting of said predetermined minimum values in said calculated fuel cut-off engine speed and fuel cut-off recovery engine speed, when said mechanical brakes are applied to said vehicle.

* * * * *